United States Patent [19]

Koroyasu et al.

[11] 4,361,311

[45] Nov. 30, 1982

[54] CARPET STRETCHER DEVICE

[75] Inventors: Arata Koroyasu, Tatsuno; Hiroshi Takenaka, Himeji, both of Japan

[73] Assignee: Kabushiki Kaisha Nihon Gijutsu Center, Himeji, Japan

[21] Appl. No.: 164,511

[22] Filed: Jul. 2, 1980

[30] Foreign Application Priority Data

Jul. 9, 1979 [JP] Japan ..... 54/94927[U]

[51] Int. Cl.[3] ..... A47G 27/04

[52] U.S. Cl. ..... 254/200; 173/117

[58] Field of Search ..... 254/200, 201, 199, 228; 294/8.6; 173/117

[56] References Cited

U.S. PATENT DOCUMENTS

| | | | |
|---|---|---|---|
| 946,267 | 1/1910 | Paulero | 173/117 X |
| 2,882,642 | 4/1959 | Hill | 254/200 X |
| 3,172,121 | 3/1965 | Doyle et al. | 173/117 X |
| 3,327,623 | 6/1967 | Diegel | 173/117 X |
| 3,572,800 | 3/1971 | Graziano | 254/200 X |
| 3,951,382 | 4/1976 | Asbury | 254/201 |
| 3,977,651 | 8/1976 | Chamberlain | 254/201 |
| 4,084,787 | 4/1978 | Kowalczyk | 254/201 |
| 4,237,987 | 12/1980 | Sherman | 173/117 |

*Primary Examiner*—John M. Jillions

*Attorney, Agent, or Firm*—Haight & Associates

[57] ABSTRACT

A carpet stretcher device comprising a body case having a handle fixed to the upper surface thereof, an electromagnetic coil axially installed in the body case, a plunger axially slidably fitted in the inner surface of the electromagnetic coil and normally urge rearwardly by a spring, and a spindle fixed to the rear end of an engaging head for engagement with carpets and axially slidably fitted in the front end of the body case, the arrangement being such that upon energization of the electromagnetic coil the plunger is advanced to strike the rear end of the engaging head with its front end.

4 Claims, 2 Drawing Figures

CARPET STRETCHER DEVICE

BACKGROUND OF THE INVENTION

The present invention relates to a carpet stretcher device.

When it is desired to lay a carpet on a floor, it is usual practice to fix one end of the carpet, which is unrolled on the floor, adjacent one wall, stretch said carpet and fix the other end of said carpet adjacent the opposite wall. A known carpet stretcher device used for stretching carpets comprises an engaging head fixed to the front end of a bar-like handle and having a number of forwardly and downwardly extending needles set in the lower surface thereof, and a pad fixed to the rear end of said bar-like handle, the arrangement being such that the operator, with his one knee and one hand on the carpet, grips said bar-like handle and manipulates the latter so as to bring the needles on the engaging head into engagement with the carpet and then he kicks said pad forwardly with his other knee (see U.S. Pat. Nos. 2,882,642 and 3,374,023). However, said known carpet stretcher device requires the operator, in using the device, to extend one knee and kick the pad with the other knee, thus forcing him to assume a constrained posture which tends to fatigue him and hurt his knees.

Another carpet stretcher device is known which comprises an engaging head, a spindle fixed at the front end thereof to said engaging head, a pipe slidably fitted on the rear portion of said spindle, a lever and link assembly interconnecting said engaging head and pipe, and an extension bar connected to the rear end of said pipe, the arrangement being such that with the rear end of said extension bar abutting against the lower portion of one wall, said lever is depressed to advance the engaging head so as to stretch the carpet (see Japanese Patent Publication No. 618/1978). With this known carpet stretcher device, the operator's knees will not be hurt, but in order to adjust the overall length of the extension bar according to the carpet size, it is necessary to successively connect additional bars, thus making it necessary to prepare a large number of extension bars. Added to this is the troublesome operation of connecting and disconnecting said extension bars. Further, since the overall length of the carpet stretcher device is almost as great as the length of the carpet as measured in the stretching direction, there has been a drawback that the operation of transversely moving the carpet stretcher device little by little is very difficult.

The present invention provides a carpet stretcher device which has eliminated the disadvantages described above.

BRIEF DESCRIPTION OF THE DRAWING

The invention will now be described in more detail with reference to the accompanying drawing, in which.

DETAILED DESCRIPTION OF THE INVENTION

Figure 2:
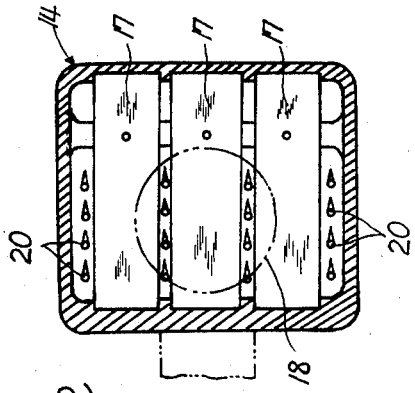
FIG. 2 is a horizontal section taken along the line II—II of FIG. 1.

A body case 1 comprises a rear case 2 and a front case 3 connected to the front end of said rear case 2. The rear case 2 has at its rear a frusto-conical inclined portion 2*a* which has formed in its rear surface an air hole 2*b*, with annular cushion rubber 4 fixed to the inner surface of the rear end thereof. The front case 3 is in the form of a cylinder having a front end surface 3*a* and a rear end surface 3*b* and serving as a yoke for forming a magnetic circuit. The front end surface 3*b* is formed with an outwardly extending neck portion 3*c* and an inwardly extending inner sleeve 3*d*. The neck portion 3*c* has a bearing bushing 5 fitted therein, while the inner sleeve portion 3*d* is formed with a taper hole 3*e* diverging rearwardly from the bore of said bearing bushing 5 and an air hole 3*f* branching from said taper hole 3*e* to communicate with the atmosphere. A front end cover 6 is fixed to the front end of the neck portion 3*c*. A bobbin 9 having an electromagnetic coil 8 wound on the outer surface thereof is axially received in said body case 1, with the front portion of said coil being fitted on said inner sleeve 3*d*. The electromagnetic coil 8 is connected to a power source cord 10 and adapted to be energized when a trigger 11 attached to a carrying handle 7 is pulled.

Installed in the body case 1 is a plunger 12 having a rear flange 12*a* having substantially the same shape as the inner surface of the inclined portion 2*a* of the rear case 2, said plunger 12 extending through the rear end surface 3*a* of the front case 3, with its front portion being slidably fitted in said bobbin 9. The plunger 12 is urged rearwardly by a spring 13 compressed between said rear end flange 12*a* and the rear end surface 3*a* of the front case 3. Further, the front end of the plunger 12 has a tapered portion 12*b* shaped for fitting in the taper hole 3*e* of the inner sleeve 3*d*, the front end of said tapered portion 12*b* being formed with a projection 12*c* adapted to be slidably fitted in the bore of said bearing bushing 5. Slidably fitted in the bearing bushing 5 is a spindle 15 fixed to the rear end of an engaging head 14 for engagement with carpets, and a step portion 15*a* formed in said spindle 15 is adapted to be locked by the front end cover 6 for the bearing bushing 5 when the spindle 15 advances. The engaging head 14, like the conventional engaging head, has secured to the lower surface thereof three thin-needle bases 17 each having a number of thin needles 16 set in the lower surface thereof and also has on its upper surface a vertically extending rotatable shaft 18 having a knob 19 fixed to the upper end thereof. The shaft 18 has a threaded portion 18*a* on which is screwed a thickneedle base 21 having a plurality of thick needles 20 set therein, so that said thick needles 20 can be lifted and lowered through clearances between said thin-needle bases 17.

Figure 1:
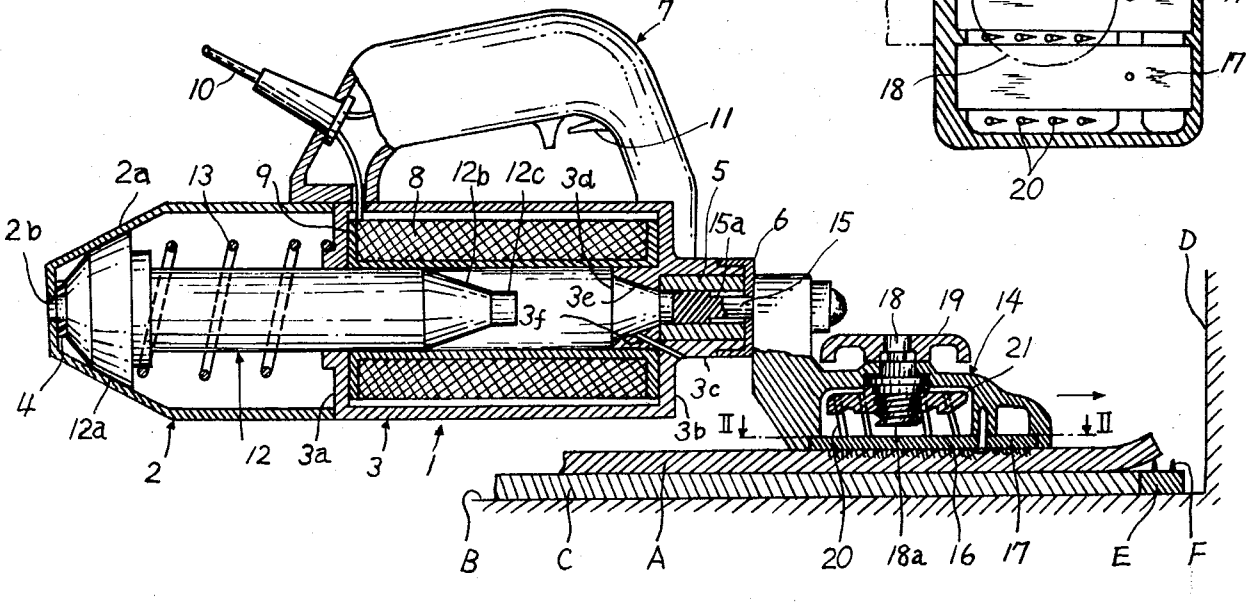
FIG. 1 is a side view, in vertical section, of an embodiment of the invention.

In the above construction, if a carpet A is relatively thin, the thick needles 20 will be lifted above the thin needles 17 to allow the latter to engage the carpet A and, conversely, if it is relatively thick, the thick needles 20 will be lowered so that both the thick and thin needles 20 and 16 will engage the carpet A. In addition, the carpet A has been unrolled on a floor B with felt C interposed therebetween, and a gripper E is fixed between the felt C and a wall D. In the FIG. 1 state, if the trigger 11 is pulled, the electromagnetic coil 8 is energized to produce a magnetic field, whereby the plunger 12 is advanced against the resilient force of the spring 13 to strike the rear end of the spindle 15 with its projection 12*c*, thereby stretching the carpet A toward the wall D. Thus, the plunger 12 is advanced by magnetic forces to strike the spindle 15 and is retracted by the resilient force of the spring 13 when the trigger 11 is released. The force which advances the plunger is greatest the moment the latter strikes the plunger. Thus, the striking force available is greater than where the plunger would strike the spindle by the resilient force of a spring and be retracted by magnetic forces, thus facilitating the carpet stretching operation. Further, since the inner sleeve 3*d* of the front case 3 serving as a yoke has its inner surface formed as a taper hole 3*e* and the front end of the plunger 12 is formed with a tapered portion 12*b*, the magnetic circuit is shorter than where no such tapered hole 3*e* and tapered portion 12*b* were formed. Further, since the bearing bushing 5 is positioned forwardly of the electromagnetic coil 8 and the tapered hole 3*e* of the front case 3 is positioned rearwardly of said bearing bushing 5 to provide for the forward stroke of the plunger 12 terminating in the vicinity of the front end of the electromagnetic coil 8, it is easy to provide an increased stroke for the plunger 12 to enable the latter to exert a greater striking force. In addition, the portion of the carpet A stretched by engaging the engaging head 14 with the same is fastened to the needles F of the gripper E and the end of the carpet A is turned down and inserted into a clearance between the gripper E and the wall D, whereupon the engaging head 14 is disengaged from the carpet A and moved laterally and another portion of the carpet A adjacent said stretched portion is then stretched in the manner described above, such operation being repeated until the entire carpet A is uniformly stretched.

In the above embodiment, the carrying handle 7 may be replaced by an upwardly extending bar-like handle to allow the operator to work in a standing posture.

As has been described so far, according to the invention, there is provided a carpet stretcher device comprising a body case having a handle fixed to the upper surface thereof, an electromagnetic coil axially installed in said body case, a plunger axially slidably fitted in the inner surface of said electromagnetic coil and normally urged rearwardly by a spring, and a spindle fixed to the rear end of an engaging head for engagement with carpets and axially slidably fitted in the front end of said body case, the arrangement being such that upon energization of said electromagnetic coil said plunger is advanced to strike the rear end of said engaging head with its front end. Thus, the present carpet stretcher device is easier to use than conventional ones and involves no danger of hurting the knees.

What is claimed is:

1. In a carpet-stretching device having a handle and a carpet-engaging head with a spindle fixed to the rear thereof, the improvement which comprises:

(a) A front body case having a forwardly extending neck portion for receiving said spindle while permitting axial sliding movement thereof, an inwardly extending inner sleeve having a tapered hole for receiving a correspondingly tapered plunger, and means for venting between said tapered hole and the atmosphere;

(b) A central portion of said front body case having an axially extending electromagnetic coil installed therein surrounding said tapered hole and extending rearwardly therefrom;

(c) An electromagnetically responsive plunger slidably fitted within said electromagnetic coil and having a conically tapered forward portion terminating in a projection axially aligned with said spindle such that the forward stroke of the plunger terminates in the vicinity of the front end of said electromagnetic coil;

(d) A rear portion of said front body case having an inwardly extending sleeve surrounding said coil and slidingly engaging the sides of said plunger; and (e) Means for normally biasing said plunger away from said spindle when said coil is de-energized.

2. A carpet-stretching device according to claim 1 wherein said biasing means is a compression spring which surrounds the rear portion of said plunger and is biased at one end against the rear portion of said front body case.

3. A carpet-stretching device according to claim 2, wherein the other end of said spring is biased against an elastomeric cushion.

4. A carpet-stretching device according to claim 3, wherein said cushion annularly surrounds a vent in a rear case for said spring.

* * * * *